US007979966B2

(12) United States Patent
Yoshie

(10) Patent No.: US 7,979,966 B2
(45) Date of Patent: Jul. 19, 2011

(54) BUCKLE

(75) Inventor: Kenichi Yoshie, Kurobe (JP)

(73) Assignee: YKK Corporation, Tokyo (JP)

( * ) Notice: Subject to any disclaimer, the term of this patent is extended or adjusted under 35 U.S.C. 154(b) by 262 days.

(21) Appl. No.: 12/174,691

(22) Filed: Jul. 17, 2008

(65) Prior Publication Data

US 2009/0056089 A1 Mar. 5, 2009

(30) Foreign Application Priority Data

Sep. 5, 2007 (JP) ..... 2007-230675

(51) Int. Cl.
*A44B 11/25* (2006.01)

(52) U.S. Cl. ..... 24/615; 24/614

(58) Field of Classification Search ..... 24/614, 24/615, 625, 629, 193, 197
See application file for complete search history.

(56) References Cited

U.S. PATENT DOCUMENTS

| | | | | |
|---|---|---|---|---|
| 5,465,472 | A * | 11/1995 | Matoba | 24/625 |
| 6,148,486 | A * | 11/2000 | Uehara et al. | 24/170 |
| 6,290,687 | B1 * | 9/2001 | Skog et al. | 604/391 |
| 7,055,226 | B2 | 6/2006 | Uehara et al. | |
| 7,100,252 | B2 | 9/2006 | Anscher | |
| 7,140,082 | B2 * | 11/2006 | Chen | 24/625 |
| 7,181,813 | B2 * | 2/2007 | Chen | 24/625 |
| 7,302,742 | B2 * | 12/2007 | Pontaoe | 24/614 |
| 7,346,965 | B2 * | 3/2008 | Hsiao | 24/625 |
| 7,650,676 | B2 * | 1/2010 | Saitsu | 24/615 |
| 2002/0040514 | A1 * | 4/2002 | Uehara et al. | 24/614 |
| 2003/0014851 | A1 * | 1/2003 | Murai et al. | 24/615 |
| 2005/0235470 | A1 * | 10/2005 | Uehara | 24/615 |
| 2006/0168783 | A1 * | 8/2006 | Anscher | 24/615 |
| 2007/0017074 | A1 * | 1/2007 | Pontaoe | 24/625 |
| 2007/0186394 | A1 * | 8/2007 | Hsiao | 24/614 |
| 2008/0178738 | A1 * | 7/2008 | Chan et al. | 95/141 |

(Continued)

FOREIGN PATENT DOCUMENTS

CN 1345558 4/2002

(Continued)

OTHER PUBLICATIONS

Office Action, dated Jan. 22, 2010, of corresponding Chinese Application No. 200810212902.6.

(Continued)

*Primary Examiner* — Robert J Sandy
*Assistant Examiner* — Michael Lee
(74) *Attorney, Agent, or Firm* — Alston & Bird LLP

(57) ABSTRACT

The male member comprises a base to which a string member can be attached, a pair of legs that project from the base, and an engaging portion that projects from a top surface and a bottom surface of a distal end of each of the pair of legs. The female member comprises: a hollow female member body that comprises an inserting opening into which the male member is inserted and an accommodating space that accommodates the pair of legs of the male member inserted through the inserting opening; an engaged portion provided to an interior of the accommodating space of the female member body with which the engaging portion of the male member is engaged; and a guiding receptacle provided to the interior of the accommodating space to guide the engaging portion to the engaged portion. A guide that abuts to the engaging portion of the male member to guide the engaging portion to the guiding receptacle is provided to the inserting opening of the female member.

3 Claims, 13 Drawing Sheets

U.S. PATENT DOCUMENTS

2009/0056089 A1* 3/2009 Yoshie ..... 24/616

FOREIGN PATENT DOCUMENTS

| | | |
|---|---|---|
| JP | 05-051110 | 7/1993 |
| JP | 2001-061513 | 3/2001 |
| JP | B2-3790094 | 4/2006 |
| JP | A-2006-129952 | 5/2006 |
| JP | A-2006-204911 | 8/2006 |
| KR | 10-0413942 | 4/2002 |
| KR | 10-2006-0088029 | 8/2006 |

OTHER PUBLICATIONS

Notice of Allowance dated Sep. 30, 2010, Korean Application No. KR9-5-2010-043825278.

* cited by examiner

BUCKLE

BACKGROUND OF THE INVENTION

1. Field of the Invention

Various embodiments of the present invention relate to a buckle that includes a male member and a female member. Specifically, various embodiments of the invention relate to a buckle that is used to couple and separate ends of a string member or to couple and separate two string members.

2. Description of Related Art

A buckle is used for coupling and separating both ends of a string member or coupling and separating two string members. For example, a coupler that includes a male member and a cylindrical female member is disclosed in Japanese Patent No. 3790094. A pair of bowing portions project from the male member in the inserting direction. The bowing portion is provided with a projection. In the female member, a guiding receptacle is formed in a tapered-groove-shaped manner from an opening, into which the male member is inserted, toward an interior hollow portion along inner surfaces of an upper wall and a lower wall. A notch with which the projection of the male member engages is formed on the rear portion of the guiding receptacle.

When the projection of the male member is aligned with the upper and lower guiding receptacles of the female member and the male member is inserted to the female member, the projection proceeds along the tapered groove of the guiding receptacle, so that the bowing portion is elastically deformed inward. When the male member reaches a predetermined position, the projection slips into the notch to be engaged, so that the male member is engaged with the female member.

There are problems with the above coupler. For example, if the male member is obliquely inserted with respect to the direction of the guiding receptacle of the female member, the projection of the male member is not aligned with the upper and lower guiding receptacles of the female member, so that the male member is stuck halfway. As a consequence, the projection of the male member is required to be correctly aligned with the upper and lower guiding receptacles of the female member in order to have the male member properly inserted into the female member, thereby causing the inserting operation of the male member to be cumbersome.

A buckle disclosed in JP-A-2006-204911 is known as being capable of solving such problems. The buckle includes a male member and a female member. The male member is provided with a base, two locking arms that protrude from the base in the same direction as each other and have respectively a locking tab on a distal end thereof, and a V-shaped center portion that projects between the locking arms in the same direction as the locking arms to form a substantially triangular shape. The female member is provided with a cylindrical hollow body, where locking ends for engaging with the locking tabs of the male member are formed and a V-shaped groove for fitting with the V-shaped center portion of the male member is notched from an inserting opening toward the rear portion.

When the male member is inserted in the female member, while the two locking arms are elastically deformed inward for insertion, the V-shaped center portion of the male member is inserted into the V-shaped groove of the female member. At this time, if the inserting direction of the male member is oblique with respect to the cylindrical axis of the female member, the V-shaped center portion of the male member is abutted to the groove face of the V-shaped groove of the female member and inserted along the groove face of the V-shaped groove. Thus, the posture of the male member is corrected. In other words, the posture of the male member is corrected so that the inserting direction of the male member is formed parallel with respect to the cylindrical axis of the female member. Accordingly, even when the male member is inserted in an inserting direction oblique with respect to the cylindrical axis of the female member, the male member can be inserted in the female member.

In the buckle disclosed in JP-A-2006-204911, the inserting posture of the male member is corrected by the V-shaped center portion disposed at the widthwise center of the male member and the V-shaped groove disposed at the widthwise center of the female member. Accordingly, the posture-correcting function does not work until the male member is inserted into the female member to a certain extent since the V-shaped center portion of the male member is not yet abutted to the groove face of the V-shaped groove of the female member.

Therefore, if the inserting direction of the male member is significantly oblique with respect to the cylindrical axis of the female member, it is possible that the posture-correction does not function, causing the male member to be stuck halfway. In this case, the male member has to be disengaged from the female member to be inserted again. To avoid this, the inserting operation needs to be conducted carefully.

SUMMARY OF VARIOUS EMBODIMENTS OF THE INVENTION

An object of various embodiments of the present invention is to provide a buckle that solves the above problems and allows a male member to be inserted in a female member without being stuck halfway.

A buckle according to an aspect of the present invention includes: a male member; and a female member into which the male member is inserted to be engaged therein, in which the male member includes a base to which a string member can be attached, a pair of legs that project from the base, and an engaging portion that projects from a top surface and a bottom surface of a distal end of each of the pair of legs, the female member includes: a hollow female member body that includes an inserting opening into which the male member is inserted and an accommodating space that accommodates the pair of legs of the male member inserted through the inserting opening; an engaged portion provided to an interior of the accommodating space of the female member body with which the engaging portion of the male member is engaged; and a guiding receptacle provided to the interior of the accommodating space to guide the engaging portion to the engaged portion, and a guide that abuts to the engaging portion of the male member to guide the engaging portion to the guiding receptacle is provided to the inserting opening of the female member.

In this arrangement, the pair of legs of the male member is inserted in the accommodating space through the inserting opening of the female member. If the inserting direction of the male member is misaligned with respect to the axis of the female member (the axis in accordance with the extending direction of the guiding receptacles) while the male member is being inserted into the accommodating space through the inserting opening of the female member, the engaging portion that projects from the top surface and the bottom surface of the distal end of each of the pair of legs of the male member is abutted to the guide formed at the inserting opening of the female member. Misalignment is caused by, for example, the inserting axis of the male member not corresponding to the axis of the female member or the inserting direction of the male member being inclined with respect to the proper inserting direction. Subsequently, the engaging portion is guided by the guide to the guiding receptacle. In other words, the posture of the male member is corrected so that the inserting direction of the male member corresponds to the axis of the female member.

When the male member is further inserted into the female member, the engaging portion is guided by the guiding receptacle to the engaged portion to be engaged therein. Therefore, even when the inserting direction of the male member is misaligned with the axis of the female member, the male member can be securely inserted without being stuck halfway.

In the buckle according to the aspect of the invention, the guide preferably includes a pair of guides that are provided on both sides of the inserting opening at ends on both sides thereof with the guiding receptacle interposed therebetween.

With this arrangement, since the guides are provided on the both sides of the inserting opening of the top wall and the bottom wall with the guiding receptacle interposed therebetween, even when the inserting direction of the male member is misaligned with the axis of the female member in the width direction, the engaging portion of the male member abuts to the guide provided to the both sides of the inserting opening of the female member. Similarly, even when the male member is inserted in a manner inclined toward either direction of the two widthwise directions with respect to the axis of the female member, the engaging portion of the male member abuts to the guide provided to the both sides of the inserting opening of the female member. Accordingly, the engaging portion of the male member can be properly guided to the guiding receptacle by the guide.

In the buckle according to the aspect of the present invention, the female member body is a hollow member including a top wall, a bottom wall, and a lateral wall that connects the top wall and the bottom wall, the engaged portion is provided to the top wall and the bottom wall, the guiding receptacle is provided to an inner surface of each of the top wall and the bottom wall in a manner that a width of the guiding receptacle gradually narrows from the inserting opening toward the engaged portion, and the guide is provided to ends of the top wall and the bottom wall adjacent to the inserting opening on the both sides of the inserting opening with the guiding receptacle interposed therebetween, and a distance between the guides provided to the both sides gradually narrows from the ends adjacent to the inserting opening toward the guiding receptacle.

With this arrangement, the guiding receptacle is formed on the inner surfaces of the top wall and the bottom wall which constitute the female member body, the guide is formed on the ends of the top wall and the bottom wall at the both sides of the inserting opening, the ends including the openings of the guiding receptacles, and the distance between the guides provided to the both sides gradually narrows from the ends adjacent to the, inserting opening toward the guiding receptacle. Accordingly, even if the inserting direction of the male member is misaligned with the axis of the female member while the male member is being inserted into the female member, the male member can be properly inserted into the female member by further pressing therein. In other words, if the inserting direction of the male member is misaligned with the axis of the female member while the male member is being inserted into the female member, the engaging portion of the male member is abutted to the guides provided to the both sides of the inserting opening in the female member. Since the distance between the guides on the both sides gradually narrows from the ends adjacent to the inserting opening toward the guiding receptacle, the engaging portions are guided along the guides toward the guiding receptacles when further pressed therein. Therefore, the inserting operation is greatly facilitated.

In the buckle according to the aspect of the present invention, a relationship of $H2<H3<H1$ preferably is satisfied, where H1 is a dimension between a face of the guiding receptacle formed on the inner surface of the top wall and a face of the guiding receptacle formed on the inner surface of the bottom wall, H2 is a dimension between the guide formed on the top wall at a side adjacent to the inserting opening and the guide formed on the bottom wall at a side adjacent to the inserting opening, and H3 is a dimension between a distal end of a top-side engaging portion projecting from a top side of a distal end of the leg and a distal end of a bottom-side engaging portion projecting from a bottom side of the distal end of the leg.

With this arrangement, the dimension H2 between the guide formed on the top wall at the side adjacent to the inserting opening and the guide formed on the bottom wall at the side adjacent to the inserting opening is smaller than the dimension H3 between the distal end of the top side of the engaging portion projecting from the top side of the distal end of the leg and the distal end of the bottom side of the engaging portion projecting from the bottom side of the distal end of the leg. Accordingly, even if the inserting direction of the male member is misaligned with the axis of the female member while the male member is being inserted into the female member, the engaging portion of the male member is securely abutted to the guide.

Further pressed, the engaging portion is guided along the guide to the guiding receptacle. At this time, the dimension H3 between the distal end of the top side of the engaging portion projecting from the top side of the distal end of the leg and the distal end of the bottom side of the engaging portion projecting from the bottom side of the distal end of the leg is smaller than the dimension H1 between the face of the guiding receptacle formed on the inner surface of the top wall and the face of the guiding receptacle formed on the inner surface of the bottom wall. Accordingly, the engaging portion can be securely guided to the guiding receptacle to be inserted therein.

In the buckle according to the aspect of the present invention, the male member and the female member preferably are fitted with each other at butting surfaces of the male member and the female member, the butting surface of the female member preferably includes an expanding portion dented from the inserting opening in an inserting direction of the male member in a U-shape or in a V-shape, the guiding receptacle preferably is provided to a center of the expanding portion and the guides are provided to both sides of the expanding portion, and the butting surface of the male member preferably includes a projecting portion to be fitted with the expanding portion.

With this arrangement, the expanding portion is provided to the butting surface of the female member. The guiding receptacles are provided to the central portion of the expanding portion. The guides are provided to the both sides of the expanding portion. Accordingly, the engaging portion of the leg can be guided to the guiding receptacle by the expanding portion by inserting the leg of the male member to the expanding portion while using the expanding portion as a guidepost. In addition, the butting surface of the male member is also provided to the projecting portion that is fitted with the expanding portion. Accordingly, the male member and the female member can be engaged with each other while the butting surfaces of the male member and the female member are closely contacted.

DETAILED DESCRIPTION OF VARIOUS EMBODIMENTS

Figure 1:
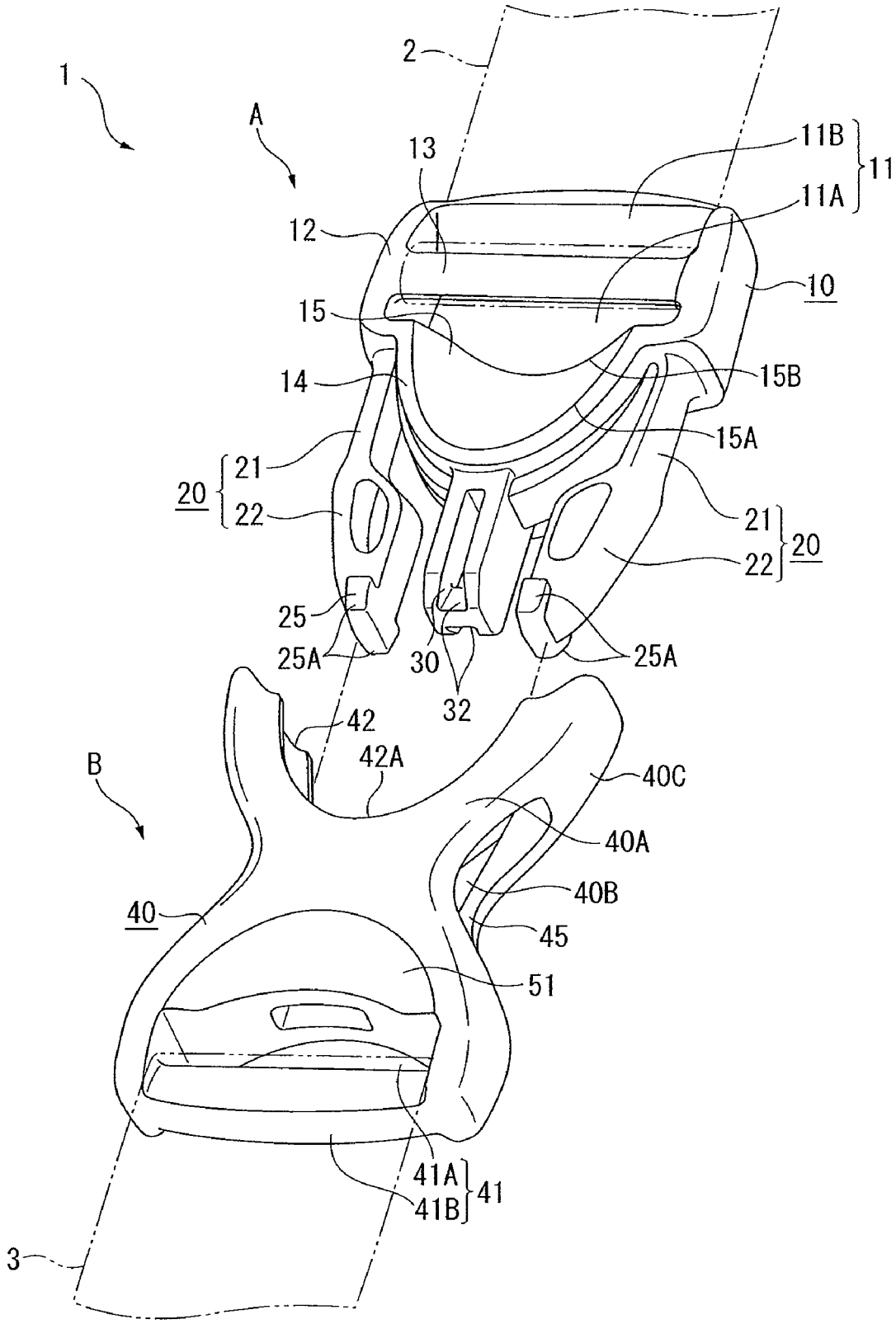
FIG. 1 is an exploded perspective view showing a buckle in disengagement according to a first embodiment of the present invention.
Figure 2:
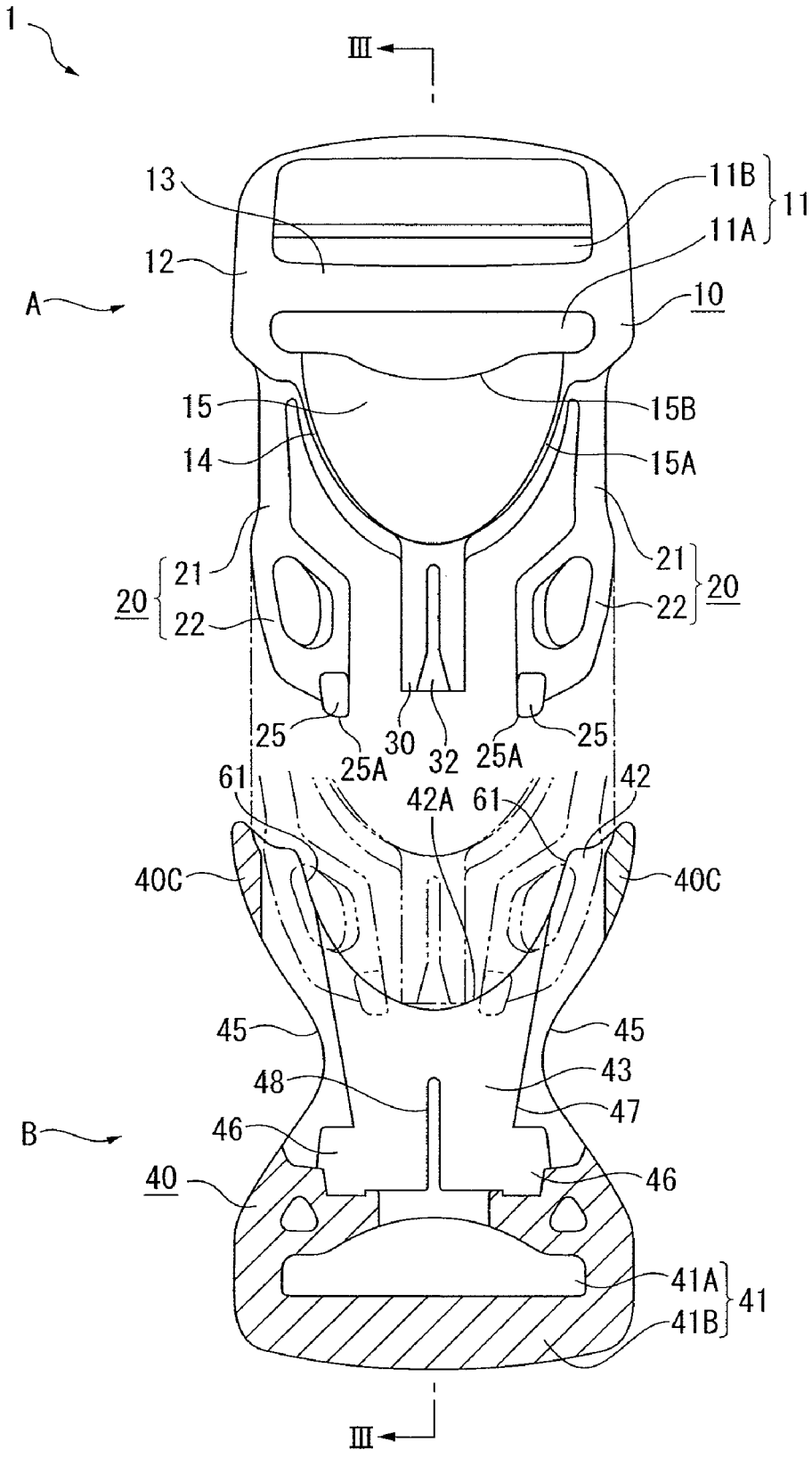
FIG. 2 is a partially-sectional plan view showing the buckle in disengagement according to the first embodiment.
Figure 3:
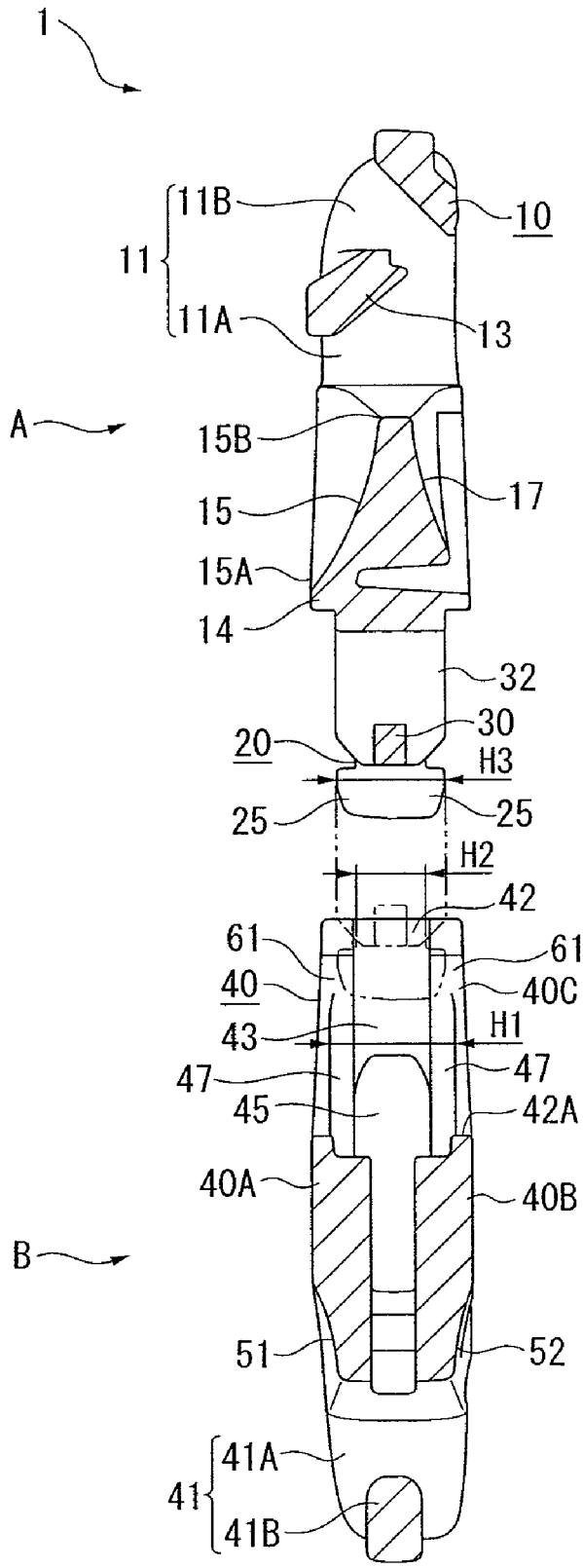
FIG. 3 is a cross-section taken along line in FIG. 2.
Figure 4:
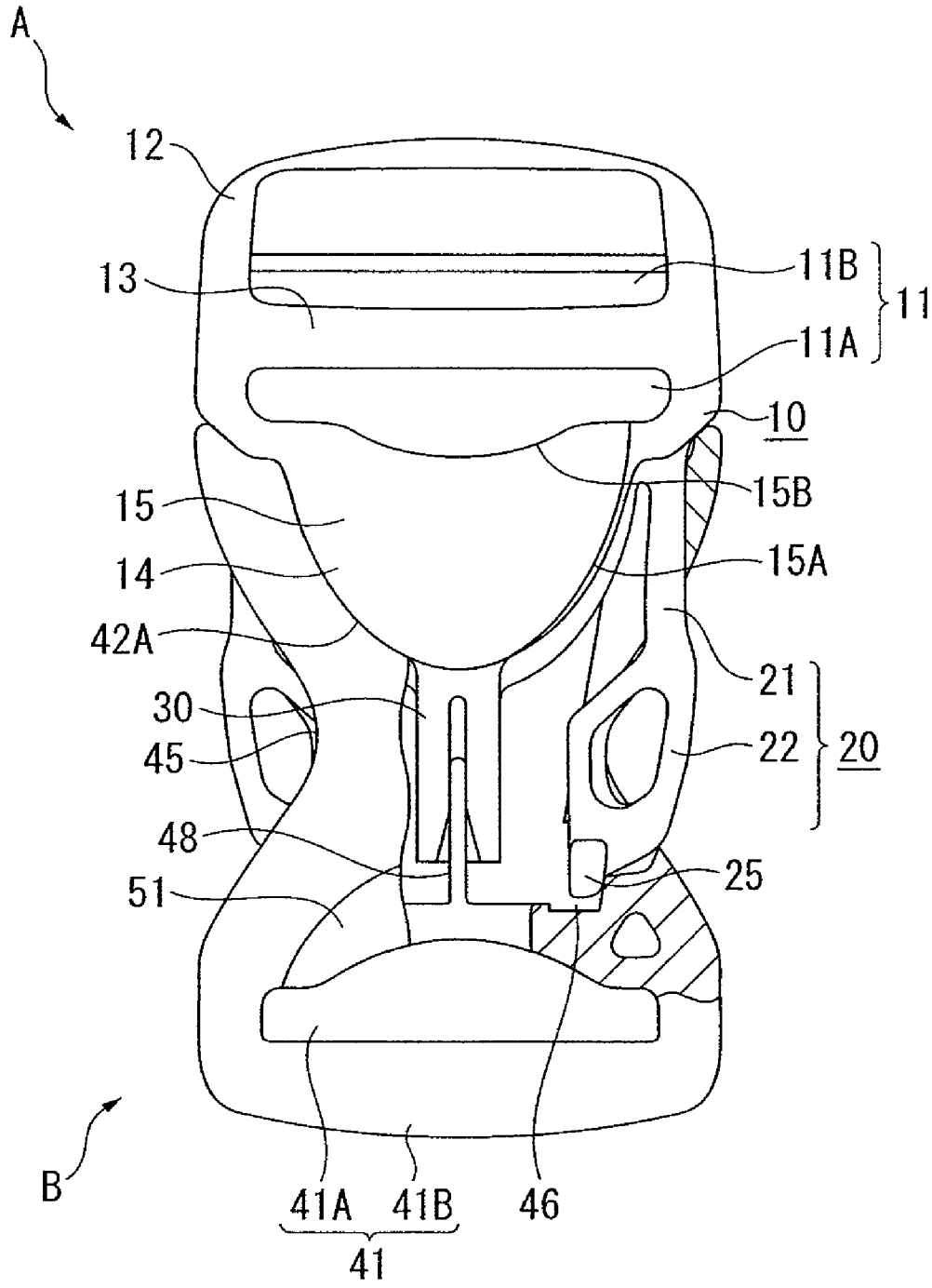
FIG. 4 is a partially-sectional plan view showing the buckle in engagement according to the first embodiment.
Figure 5:
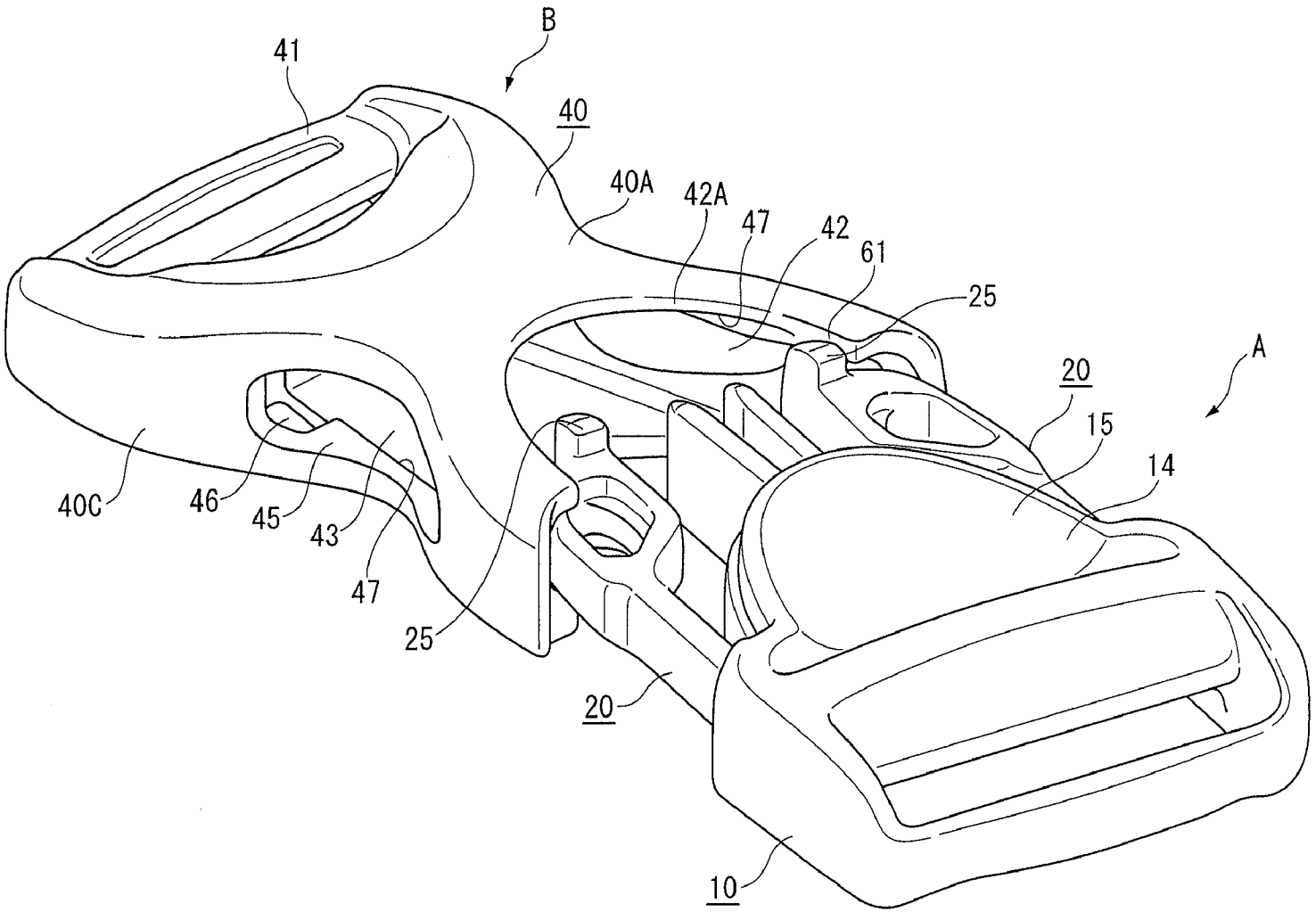
FIG. 5 is a perspective view showing a male member being inserted into a female member in the first embodiment.
Figure 6:
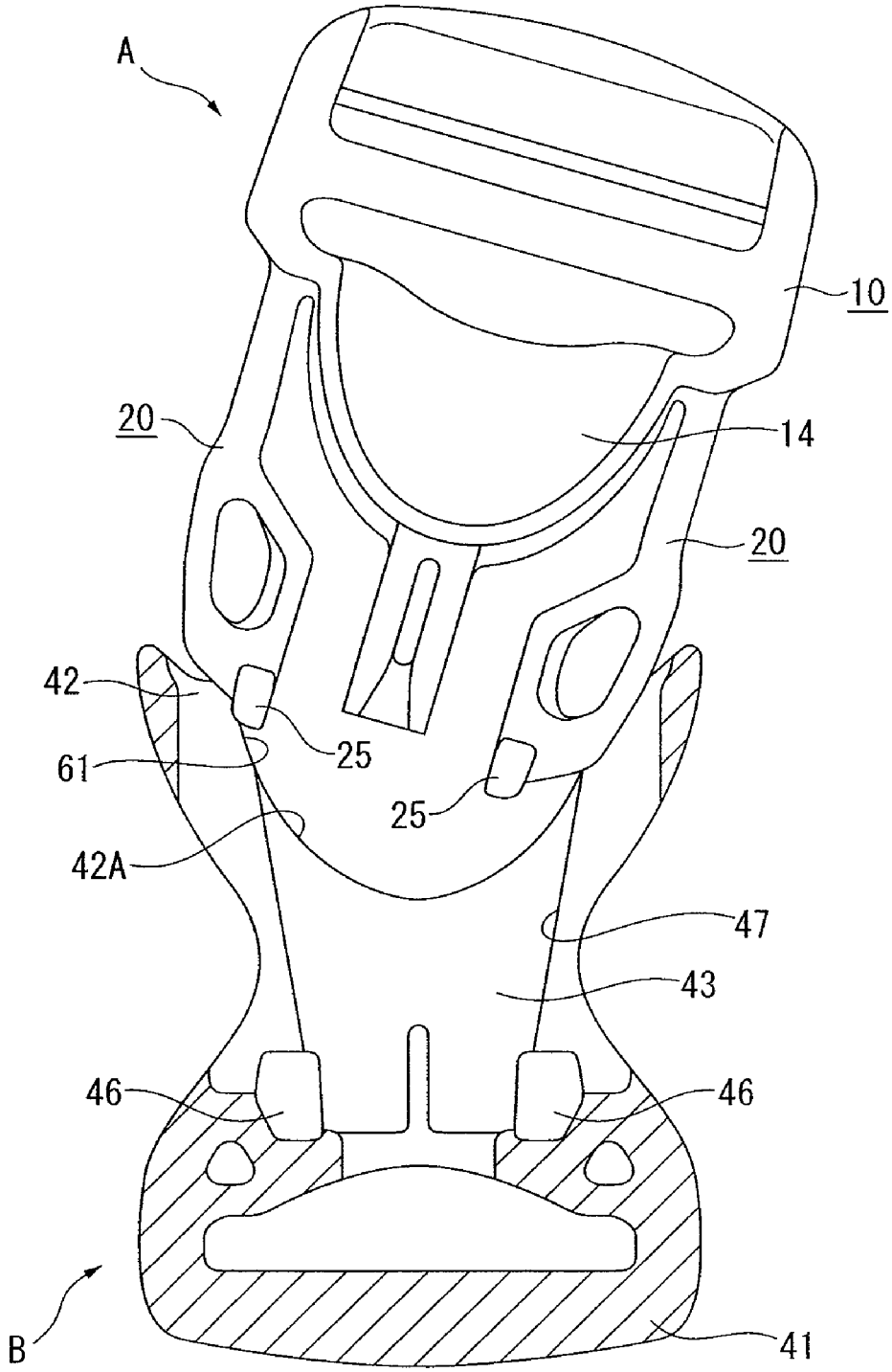
FIG. 6 is a partially-sectional plan view showing the male and female members in FIG. 5.

Various embodiments of the present invention will be described below with reference to the drawings. FIG. 1 is an exploded perspective view showing a buckle in disengagement according to a first embodiment. FIG. 2 is a partially-sectional plan view showing the buckle in disengagement. FIG. 3 is a cross-section taken along line in FIG. 2. FIG. 4 is a partially-sectional plan view showing the buckle in engagement. FIG. 5 is a perspective view showing a male member being obliquely inserted into a female member. FIG. 6 is a partially-sectional plan view showing the members in FIG. 5.

As shown in FIG. 1-6, the buckle 1 according to the embodiment for coupling and separating ends 2 and 3 of a string member includes a male member A integrally formed by a synthetic resin and a female member B also integrally formed by a synthetic resin into which the male member A is inserted to be engaged therein. Note that a material for the male member A and the female member B is not limited to a synthetic resin, but may be other materials such as a metal.

The male member A includes: a base 10; a pair of legs 20 that project in parallel to each other from both widthwise sides of the base 10 (the widthwise direction being perpendicular to an inserting direction of the male member A), the legs 20 being elastically deformable in a direction intersecting the inserting direction of the male member A (specifically, in a direction substantially perpendicular to the inserting direction); and a lateral-slippage-restricting piece 30 projecting between the legs 20 to be parallel to the legs 20.

The base 10 includes: a frame 12 having at a central interior portion thereof a string attachment hole 11 (a string attachment portion) into which the end 2 of the string member is inserted to be engaged therein; and a projecting portion 14 projecting in the same direction as the legs 20 from a side of the frame 12 from which the legs 20 project.

A connecting bar 13 is bridged over the middle of the string attachment hole 11 in a widthwise direction of the frame 12. The connecting bar 13 partitions the string attachment hole 11 into two string attachment holes 11A and 11B respectively on a front side near the legs 20 and on a rear side opposite to the front side, the front and the rear being relative to the inserting direction. Thus, the string member can be inserted into the string attachment holes 11A and 11B and folded bottom around the connecting bar 13, so that the length of the string member can be adjusted.

The projecting portion 14 disposed between the pair of legs 20 projects in a projecting direction of the legs 20 from a side of the base 10 from which the legs 20 project, that is, a butting surface against the female member B. Specifically, an inserting-directional front end of the projecting portion 14 is shaped substantially in a contour of a fingertip such that projecting amounts gradually increase from the width-directional ends to the middle of the base 10 to form an arc (more specifically, a parabola).

A recess 15 is formed on a top surface of the projecting portion 14. The recess 15 has a front end 15A and a rear end 15B, the front and rear being relative to the inserting direction of the male member A. A surface connecting the front end 15A and the rear end 15B (a top surface of the recess 15) is formed with the width-directional middle of the rear end 15B located at the lowest position, the surface extending from the lowest position toward the front end 15A while gradually becoming higher to define a curved surface (a parabolic surface). In short, the surface connecting the front end 15A and the rear end 15B curves to coincide with a contour of a finger ball.

A recess 17 is formed on a bottom surface of the projecting portion 14. The recess 17 has the same shape as the recess 15.

Each of the legs 20 includes an elastic leg piece 21 and a guide leg piece 22. The elastic leg pieces 21 linearly extend in the inserting direction of the male member A respectively from both widthwise sides of the base 10, and are elastically deformable in a direction toward and apart from each other. The guide leg piece 22 extends from a distal end of the elastic leg piece 21 in the inserting direction of the male member A.

In a cross section of the elastic leg pieces 21, a dimension in the elastically deforming direction (widthwise dimension) is smaller than a dimension in the front-rear direction.

One of the guide leg pieces 22 is bifurcated to form branches, which are merged at a distal end of the guide leg piece 22, and has an outer surface that is sloped toward the distal end thereof inward, i.e., in a direction such that the pair of the legs 20 approach each other direction.

An engaging portion 25 is constituted by a projection 25A that projects from a top surface and a bottom surface of the distal end of the guide leg piece 22.

The lateral-slippage-restricting piece 30 projects from a distal end of the projecting portion 14 in parallel to the pair of legs 20. Engaging grooves 32 are formed respectively in the middle of each of top and bottom surfaces of the lateral-slippage-restricting piece 30 and extend in a projecting direction of the lateral-slippage-restricting piece 30.

The female member B includes a flat hollow female member body 40 that has a top wall 40A (a top surface), a bottom wall 40B (a bottom surface), and a pair of lateral walls 40C connecting the top wall 40A and the bottom wall 40B.

An inserting opening 42 into which the male member A is inserted is provided to an end of the female member body 40. A string attachment portion 41 into which the end 3 of the string member is inserted to be engaged therein is provided to the other end of the female member body 40. An accommodating space 43 for accommodating the legs 20 of the male member A is provided inside the female member body 40. An expanding portion 42A is formed on the top wall 40A and the bottom wall 40B that define an inserting opening 42 of the female member B with middle parts curved inward to form an arc (a parabola). The projecting portion 14 of the male member A is accommodated in the expanding portion 42A. In other words, the projecting portion 14 of the male member A and the expanding portion 42A of the female member B are abutted to be fitted with each other. The string attachment portion 41 includes a string attachment hole 41A and a connecting bar 41B.

Recesses 51 and 52 are formed on a top surface and a bottom surface of the female member body 40 adjacent to the string attachment hole 41A. The recesses 51 and 52 substantially have the same shape as the recesses 15 and 17 of the male member A.

As shown in FIGS. 2 and 4, leg openings 45 are formed in remote lateral walls of the accommodating space 43 to expose the legs 20 of the male member A to the outside. The leg openings 45 are cut out in the lateral walls 40C of a circumferential wall of the female member body 40, the leg opening 45 extending inward between the top and bottom walls 40A and 40B in a concaved manner.

On inner sides of the top and bottom walls 40A and 40B and on a remote side in the accommodating space 43 relative to the leg opening 45, concave engaged portions 46 are formed. Guiding receptacles 47 for guiding the engaging portions 25 provided to the legs 20 toward the engaged portions 46 extend from a central portion excluding both ends of the expanding portion 42A to the engaged portions 46.

A width of the guiding receptacle 47 gradually narrows from the expanding portion 42A (the inserting opening 42) toward the engaged portions 46. Accordingly, the legs 20 are elastically deformed in directions substantially perpendicular to the inserting direction (inward directions) while being inserted into the female member B to be engaged with the engaged portions 46. On inner surfaces of the top wall 40A and the bottom wall 40B, prongs 48 that fit in the engaging grooves 32 of the lateral-slippage-restricting piece 30 are provided along the inserting direction of the male member A.

Guides 61 that abut to the engaging portions 25 of the male member A to guide the engaging portions 25 to the guiding receptacles 47 are provided on both sides of the expanding portion 42A. In other words, the guides 61 are provided to end surfaces at the both sides of the inserting opening 42 with the guiding receptacles 47 interposed therebetween.

The guides 61 are formed at ends adjacent to the inserting opening 42 of the top wall 40A and the bottom wall 40B, that is, at ends on both sides of an opening periphery of the inserting opening 42 with the guiding receptacles 47 interposed therebetween. The guides 61 on the both sides with the guiding receptacles 47 interposed therebetween are sloped, such that the guides 61 become closer to each other in the inserting direction of the male member A. In other words, the distance between the guides 61 formed at the both sides gradually narrows from the ends adjacent to the inserting opening 42 toward the guiding receptacles 47. In short, the guide 61 is configured to coincide with a part of an arc or a parabola defined by the expanding portion 42A.

When H1 refers to a dimension between a face of the guiding receptacle 47 formed on the inner surface of the top wall 40A and a face of the guiding receptacle 47 formed on the inner surface of the bottom wall 40B, H2 refers to a dimension between the guide 61 formed on the top wall 40A at a side adjacent to the inserting opening 42 and the guide 61 formed on the bottom wall 40B at a side adjacent to the inserting opening 42, and H3 refers to a dimension between a distal end of a top-side engaging portion 25 projecting from a top side of a distal end of the leg 20 and a distal end of a bottom-side engaging portion 25 projecting from a rear side of the distal end of the leg 20 as shown in FIG. 3, H2<H3<H1 is satisfied.

In the arrangement, to engage the male member A with the female member B, the top and bottom surfaces of the male member A are pinched by the thumb and the index finger of a hand while the top and bottom surfaces of the female member are pinched by the thumb and the index finger of the other hand.

Regarding the top and bottom surfaces of the male member A, since the recesses 15 and 17 are formed on the top and bottom surfaces of the projecting portion 14 that projects from the base 10, the thumb and the index finger can be placed thereon. Accordingly, a user can easily pinch the top and bottom surfaces of the male member A to conduct an operation. Additionally, since the recesses 51 and 52 are also formed on the top and bottom surfaces of the female member B, the thumb and the index finger of the other hand can be placed thereon, so that the user can also pinch the top and bottom surfaces of the female member B with ease.

After the male member A and the female member B are thus pinched with fingers, the male member A is inserted in the female member B. Then, the male member A advances into the female member B with the engaging portions 25 provided on the distal ends of the legs 20 being guided in the guiding receptacles 47. Since the guiding receptacles 47 are arranged to narrow toward a remote side in the female member B, the legs 20 are inserted while respectively being elastically deformed inward.

When the male member A is inserted to a depth where the engaging portions 25 of the legs 20 have advanced beyond the engaged portions 46 of the female member B, the legs 20 having been elastically deformed inward elastically restore (in outward directions), so that the engaging portion 25 of the legs 20 can be engaged with the engaged portions 46 of the female member B.

Consequently, as shown in FIG. 4, the male member A is engaged with the female member B. In this state, the projecting portion 14 of the male member A fits in the expanding portion 42A of the female member B with little gap, so that rattling of the buckle can be reduced and appearance of the buckle can be improved to be neat.

Furthermore in this state, since the prong 48 of the female member B is fitted in the engaging groove 32 formed on the lateral-slippage-restricting piece 30 of the male member A, a widthwise movement of the male member A relative to the female member B is restricted. For example, if an external force (an inwardly pressing force) except a force intentionally applied to disengage the buckle 1 is applied to one of the legs 20 of the male member A, the male member A is moved widthwise to a side opposite to the source of the force without the lateral-slippage-restricting piece 30. At this time, the base portion of the other of the legs 20 abuts to the lateral wall 40C of the female member B so that the other of the legs 20 is elastically deformed inward. As a result, the engaging portion 25 provided to the distal end of the leg 20 may be disengaged from the engaged portion 46 so that the male member A is disengaged from the female member B. However, in the present embodiment, since the prong 48 of the female member B is fitted in the engaging groove 32 formed on the lateral-slippage-restricting piece 30 of the male member A, a widthwise movement of the male member A relative to the female member B is restricted, thereby preventing the male member A from being disengaged from the female member B.

If the inserting direction of the male member A is misaligned with respect to the axis of the female member B (the axis in accordance with the extending direction of the guiding receptacles 47) while the male member A is being inserted into the accommodating space 43 through the inserting opening 42 of the female member B, the engaging portion 25 of the male member A is not aligned with the guiding receptacle 47 of the female member B. Misalignment is caused by, for example, the inserting axis of the male member A not corresponding to the axis of the female member B or, as shown in FIG. 5, the inserting direction of the male member A being inclined with respect to the proper inserting direction.

In this case, the engaging portion 25 that projects from a top surface and a bottom surface of the distal end of each of the pair of legs 20 of the male member A is abutted to the guide 61 formed at the inserting opening 42 of the female member B. In other words, since the dimension H2 between the guide 61 formed on the top wall 40A at a side adjacent to the inserting opening 42 and the guide 61 formed on the bottom wall 40B at a side adjacent to the inserting opening 42 is smaller than the dimension H3 between a distal end of the top side of the engaging portion 25 projecting from a front side of a distal end of the leg 20 and a distal end of the bottom side of the engaging portion 25 projecting from a rear side of a distal end of the leg 20, if the inserting direction of the male member A is misaligned with the axis of the female member B while the male member A is being inserted into the female member B, the engaging portion 25 is abutted to the guides 61.

In addition, since the distance between the guides 61 formed at the both sides gradually narrows from the ends adjacent to the inserting opening 42 toward the guiding receptacles 47, the engaging portion 25 is guided by the guide 61 to the guiding receptacle 47. In other words, the posture of the male member A is corrected so that the inserting direction of the male member A corresponds to the axis of the female member B. At this time, since the dimension H3 between a distal end of the top side of the engaging portion projecting from a front side of a distal end of the leg 20 and a distal end of the bottom aide of the engaging portion 25 projecting from a rear side of a distal end of the leg 20 is smaller than the dimension H1 between a groove bottom of the guiding receptacle 47 formed on the inner surface of the top wall 40A and the groove bottom of the guiding 15 receptacle 47 formed on the inner surface of the bottom wall 40B, the engaging portion 25 is guided and inserted into the guiding receptacle 47.

Therefore, even when the inserting direction of the male member A is misaligned with the axis of the female member B, the male member A can be securely inserted without being stuck halfway.

Especially, since the guides 61 are formed at the ends adjacent to the inserting opening 42 of the top wall 40A and the bottom wall 40B, even when the inserting direction of the male member A is misaligned with the axis of the female member B in the width direction, the engaging portion 25 of the male member A abuts to the guide 61 formed at ends on both sides of the inserting opening 42 of the female member B. Similarly, even when the male member A is obliquely inserted in any directions of the width direction with respect to the axis of the female member B, the engaging portion 25 of the male member A abuts to the guide 61 formed at ends on both sides of the inserting opening 42 of the female member B. Accordingly, the engaging portion 25 of the male member A can be guided to the guiding receptacle 47 by the guide 61.

Further, the expanding portion 42A is provided to the butting surface of the female member B. The guiding receptacles 47 are provided to the central portion of the expanding portion 42A. The guides 61 are provided to the both sides of the expanding portion 42A. On account of the arrangement, the engaging portion 25 of the leg 20 can be guided to the guiding receptacle 47 formed at the central portion of the expanding portion 42A by the guide 61 formed at both sides of the expanding portion 42A by inserting the leg 20 of the male member A to the expanding portion 42A while using the expanding portion 42A as a guidepost.

In addition, regions of the inserting opening 42 to which the guide 61 are provided, that is, right and left sides of the inserting opening 42, are thicker in the top-bottom direction than the central portion of the inserting opening 42. The thick portions extend along both sides of the guiding receptacle 47 toward the inside of the female member B, so that the surrounding of the opening 45 provided to left and right sides of the female member B are also thick. Accordingly, the surrounding of the opening 45 is reinforced to enhance the strength.

When the male member A is to be disengaged from the female member B, the legs 20 which project from the leg openings 45 of the female member B are pressed inward, so that the legs 20 of the male member A are elastically deformed inward.

At this time, the engaging portion 25 is disengaged from the engaged portion 46. Here, the male member A can be disengaged from the female member B by pulling out the male member A from the female member B.

Figure 7:
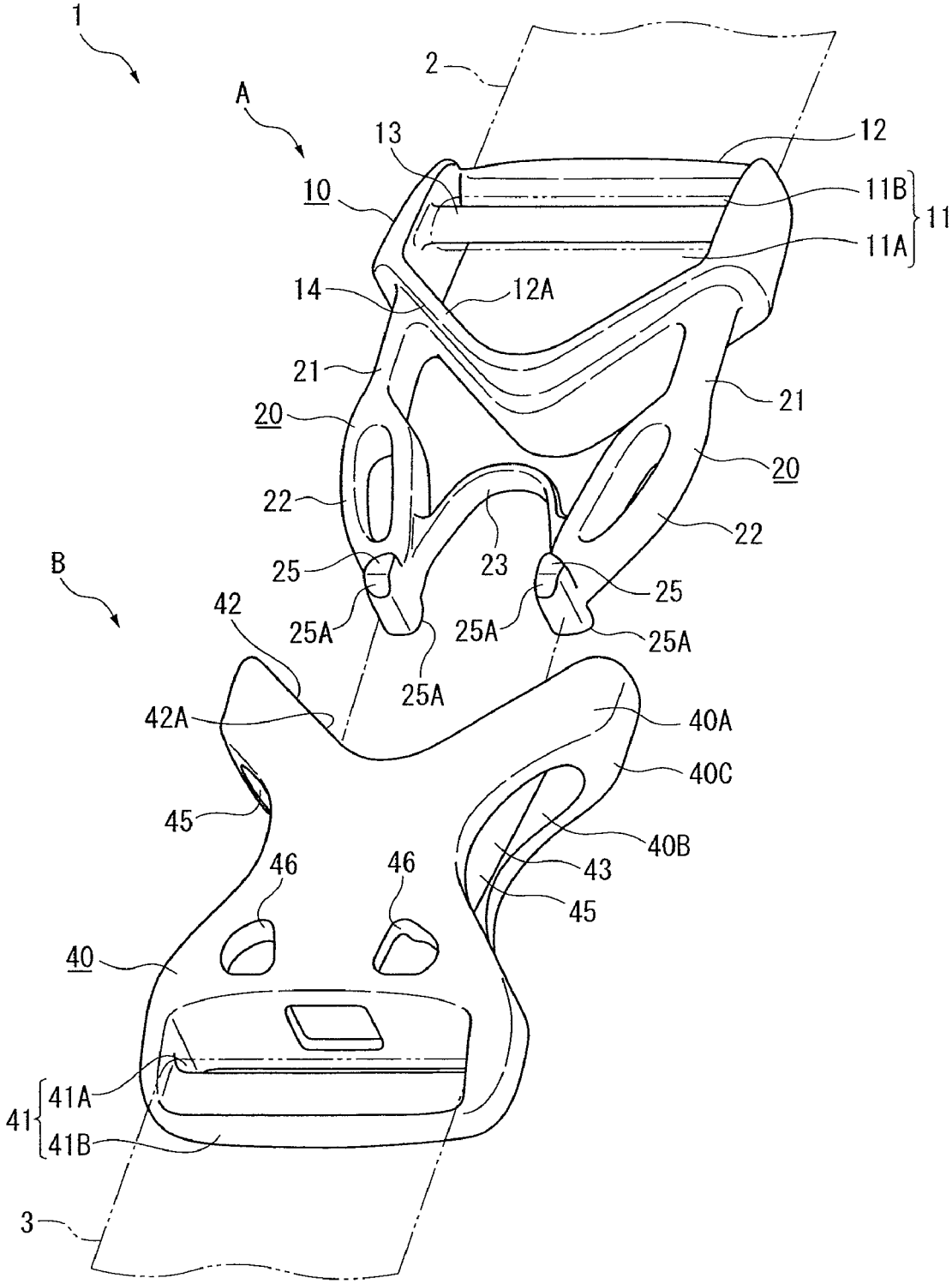
FIG. 7 is an exploded perspective view showing the buckle according to a second embodiment of the present invention.
Figure 8A:
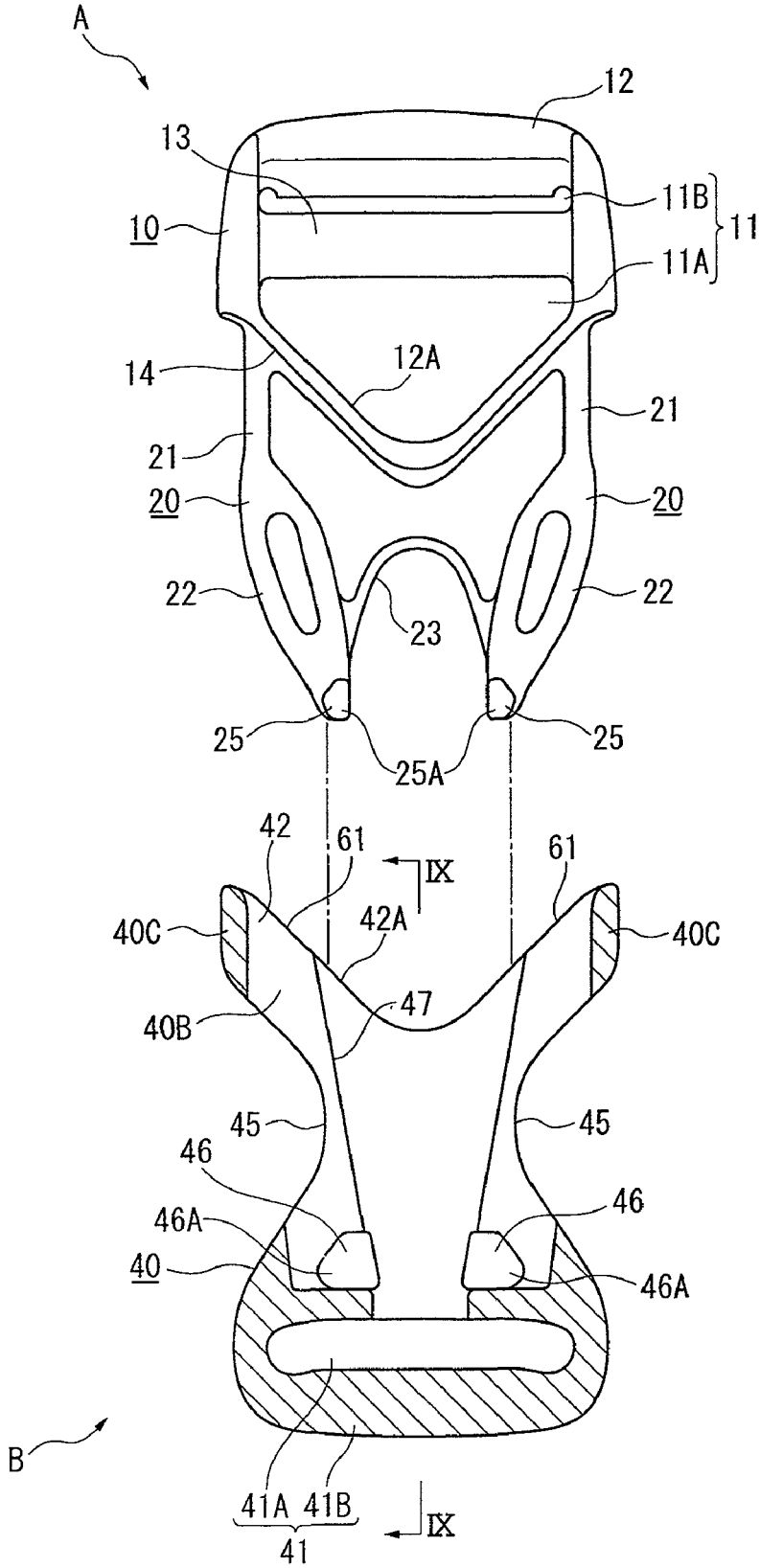
FIG. 8A is a partially-sectional plan view showing the buckle in disengagement according to the second embodiment.
Figure 8B:
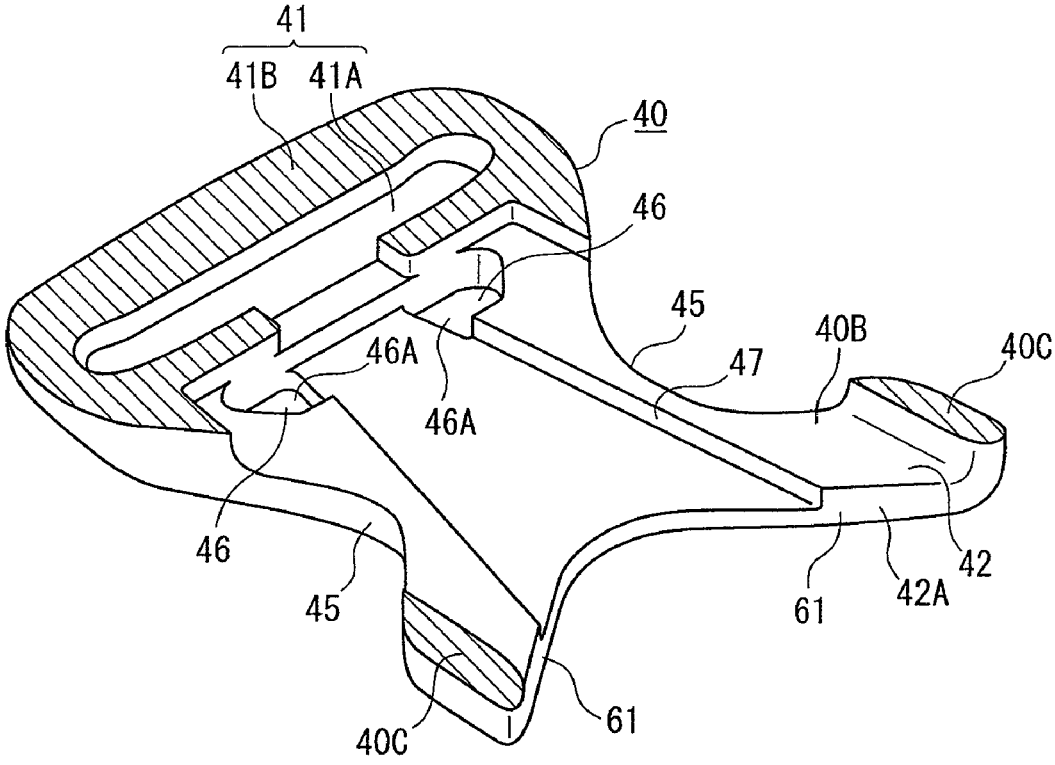
FIG. 8B is a partially-sectional perspective view of the female member B according to the second embodiment.
Figure 9:
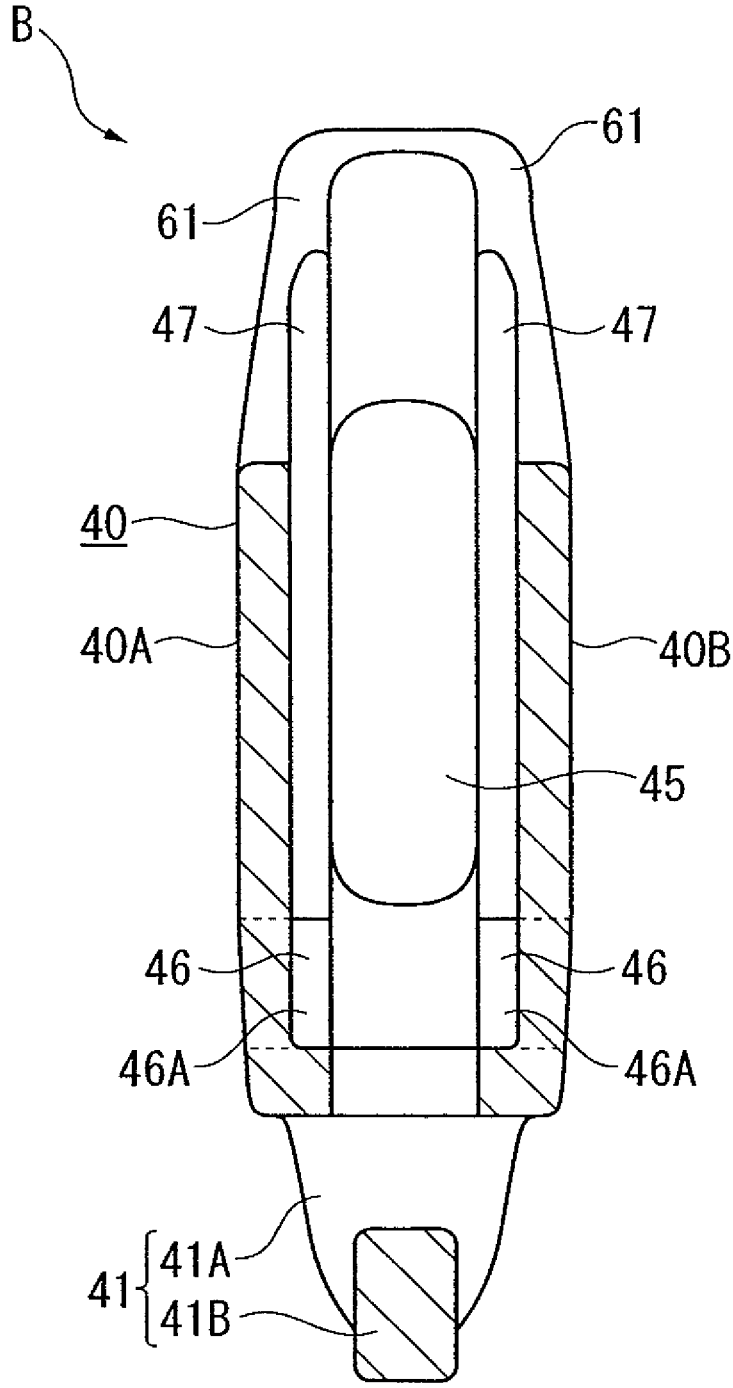
FIG. 9 is a cross-section taken along IX-IX line in FIG. 8A.
Figure 10:
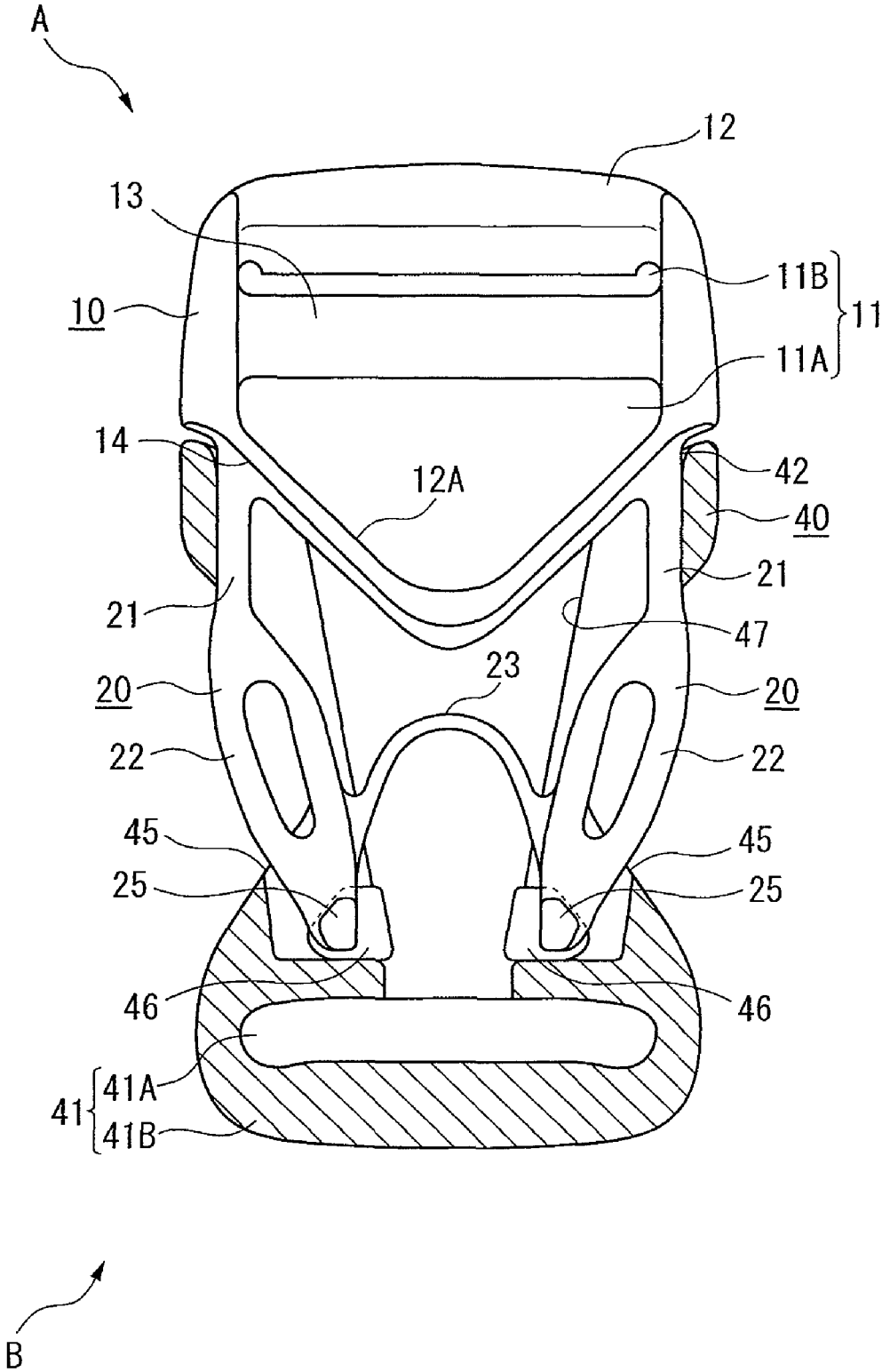
FIG. 10 is a partially-sectional plan view showing the buckle in engagement according to the second embodiment.
Figure 11:
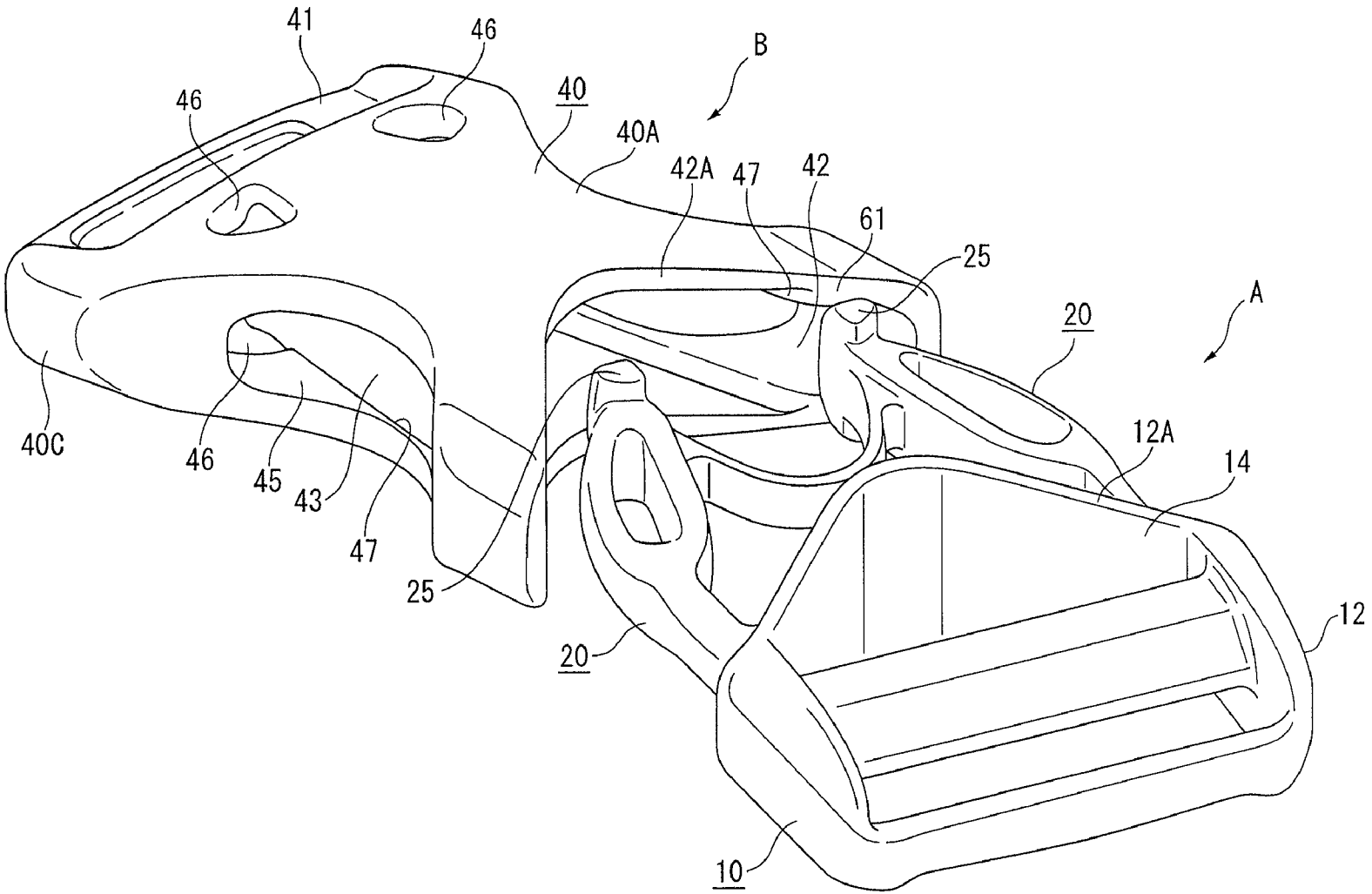
FIG. 11 is a perspective view showing the male member being inserted into the female member according to the second embodiment.
Figure 12:
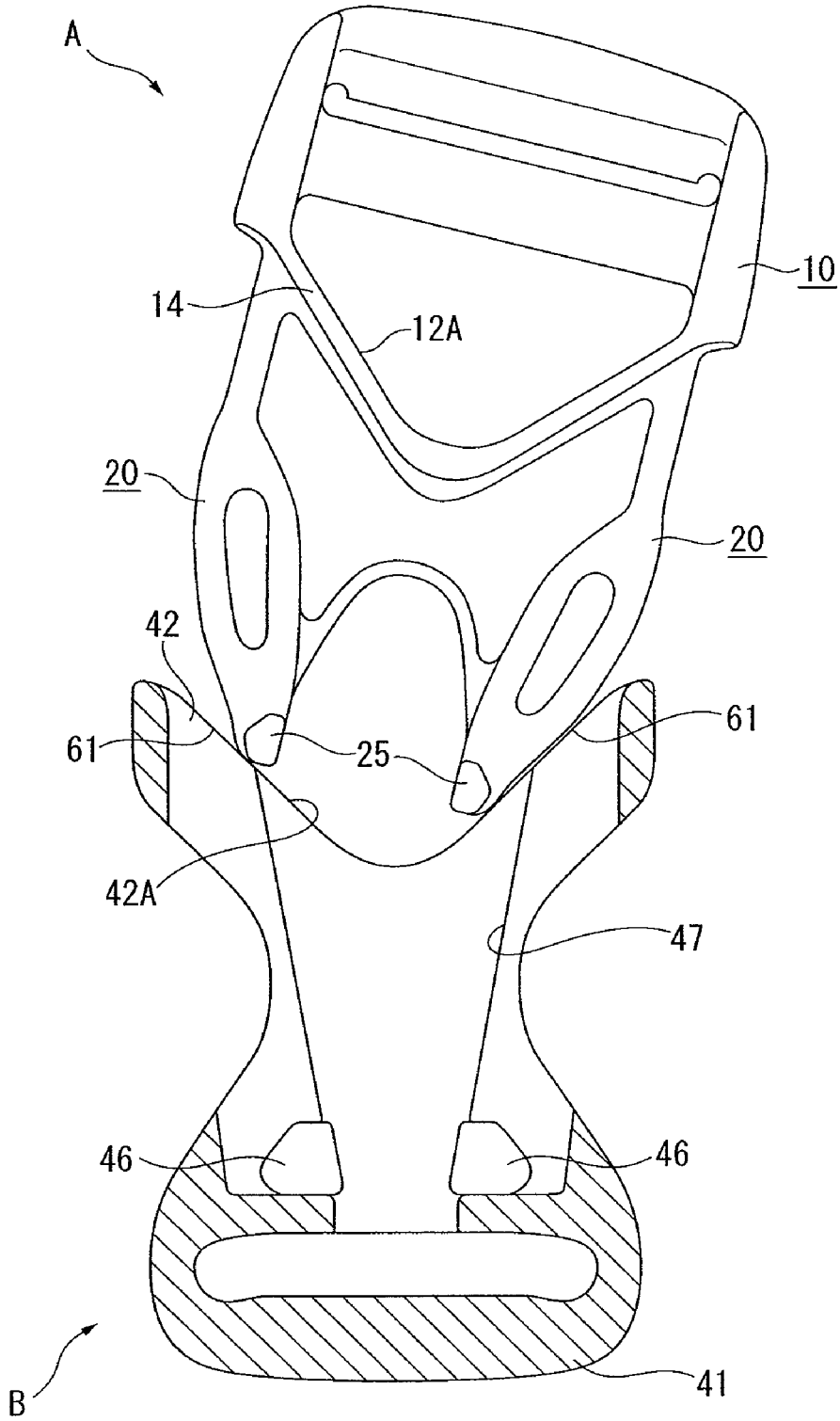
FIG. 12 is a partially-sectional plan view showing the members in FIG. 11.

FIG. 7 is an exploded perspective view showing a buckle in disengagement according to a second embodiment. FIG. 8A is a partially-sectional plan view showing the buckle in disengagement. FIG. 8B is a partially-sectional perspective view of the female member. FIG. 9 is a cross-section taken along IX-IX line in FIG. 8A. FIG. 10 is a partially-sectional plan view showing the buckle in engagement. FIG. 11 is a perspective view showing the male member being inserted into the female member. FIG. 12 is a partially-sectional plan view showing the members in FIG. 11. In the following description of these figures, the same elements as the first embodiment will be denoted by the same reference symbols, and the description thereof will be omitted or simplified.

In the buckles according to the second embodiment, the male member A differs from that of the first embodiment in the shapes of the projecting portion 14, the leg 20, and the engaging portion 25, and the female member B differs from that of the first embodiment in the shapes of the expanding portion 42A and the engaged portion 46.

In the projecting portion 14 of the second embodiment, the frame member 12A in the frame 12 to which the legs 20 are provided is curved in a manner projecting in the projecting direction of the legs 20. In other words, the projecting portion 14 is substantially V-shaped in a manner that the central portion of the frame member 12A is more projected than both ends of the frame member 12A in the projecting direction of the legs 20.

Regarding the legs 20 of the second embodiment, the lateral-slippage-restricting piece 30 in the middle is omitted, and the inner surfaces of the pair of guide leg pieces 22 are connected by an elastic connecting belt 23. The connecting belt 23 is curved in an inversely U-shaped manner with the bottom of U being adjacent to the frame member 12A. Accordingly, the connecting belt 23 prevents the pair of guide leg pieces from being deformed in excess of the predetermined range, thereby preventing the legs 20 from being damaged when excessive pulling force (outwardly pulling force) is applied to the legs 20.

The engaging portion 25 of the second embodiment is formed by a substantially pentagonal projection 25A that projects from the top and bottom surfaces of the distal end of the guide leg piece 22 of each of the pair of legs 20.

In the expanding portion 42A of the second embodiment, central portions of the top wall 40A and the bottom wall 40B which form the inserting opening 42 is inwardly dented in a substantially V-shaped manner. In the second embodiment, an opening of the guiding receptacle 47 is also provided to a central portion of the expanding portion 42A and the guide 61 is provided to both sides of the guiding receptacle 47. Accordingly, the width of the guide 61 of the second embodiment gradually narrows in a tapered manner from the inserting opening 42 toward the guiding receptacle 47.

The engaged portion 46 of the second embodiment is formed as a substantially pentagonal recess 46A in correspondence with each of the engaging portions 25. An opening of the recess 46A formed on the top wall 40A is provided to an outer surface of the top wall 40A, and an opening of the bottom wall 40B is provided to an outer surface of the bottom wall 40B.

The same effects and the advantages as the first embodiment can be obtained by the buckle according to the second embodiment.

If the inserting direction of the male member A is misaligned with respect to the axis of the female member B (the axis in accordance with the extending direction of the guiding receptacles 47) while the male member A is being inserted into the accommodating space 43 through the inserting opening 42 of the female member B, the engaging portion 25 of the male member A is not aligned with the guiding receptacles 47 of the female member B. Misalignment is caused by, for example, the inserting direction of the male member A being inclined with respect to the proper inserting direction as shown in FIG. 11.

In this case, the engaging portion 25 that projects from a top surface and a bottom surface of the distal end of each of the pair of legs 20 of the male member A is abutted to the guide 61 formed at the inserting opening 42 of the female member B. Here, the guide 61 guides the engaging portion 25 to the guiding receptacle 47 of the female member B. In other words, the posture of the male member A is corrected so that the inserting direction of the male member A corresponds to the axis of the female member B. Accordingly, when the male member A is further inserted into the female member B, the engaging portion 25 is guided to the engaged portion 46 to be engaged therein. Therefore, even when the inserting direction of the male member A is misaligned with the axis of the female member B, the male member A can be securely inserted without being stuck halfway.

The present invention is not limited to the buckle described in the above embodiment, but includes the following modifications.

In the above embodiment, the expanding portion 42A dented in an arc-shaped or V-shaped manner is provided to the top wall 40A and the bottom wall 40B at a side adjacent to the inserting opening 42 of the female member B, the opening of the guiding receptacle 47 is provided to the central portion of the expanding portion 42A, and the guides 61 are provided to both sides of the expanding portion 42A. However, the expanding portion 42A is not always necessary. In other words, the guides 61 may be provided to the inserting opening 42 of the female member B without the expanding portion A. With this arrangement, that is, without the expanding portion 42A in the female member B, the strength of the female member can be enhanced.

The shape of the guide 61 is not limited to a shape which constitutes a part of the arc-shape of the expanding portion 42A or a tapered shape which constitutes a part of V-shape described in the above embodiments, but may be other suitable shapes. In other words, as far as the male member A and the engaging portion 25 are abutted with each other and the abutted engaging portion 25 is guided to the guiding receptacle 47 by the pressing force of the male member, the guide 61 may take any suitable shape.

In the above embodiments, the male member A and the female member B are respectively provided with a string attachment portion, specifically, the frame 12 having the string attachment hole 11 or the string attachment portion 41. However, the female member B may be provided without the string attachment portion 41. In other words, the female member body 40 of the female member B may be fixed directly to another member.

Further, the end of the string member may be integrally fixed to the string attachment portion 41 of the female member body 40 upon injection molding of the female member B.

In other words, the end of the string member may be integrally molded by insert molding upon injection molding of the female member B. The string member is not limited to a wide belt, but may be a thin string with a small width such as a round string. A string insertion hole which allows a thin string (round string) and the like to pass through may be provided to the male member A or the female member B. In this case, a thin string (round string) is inserted through the strip attachment hole, and a knot is made at a distal end of the thin string (round string) protruding from the string attachment hole, which works as a detachment-stopper.

Preferable embodiments and various modifications of the present invention have been exemplified above, but it should be noted that these embodiments and modifications may be employed in combination.

The priority application number JP 2007-230675 upon which this patent application is based is hereby incorporated by reference.

What is claimed is:

1. A buckle, comprising:

a male member; and a female member into which the male member is inserted to be engaged therein, wherein:

the male member comprises:

a base to which a string member can be attached, a pair of legs that project from the base, and an engaging portion that projects from a top surface and a bottom surface of a distal end of each of the pair of legs, the female member comprises:

a hollow female member body that comprises a top wall, a bottom wall, a pair of lateral walls connecting the top wall and the bottom wall, an inserting opening into which the male member is inserted and an accommodating space that accommodates the pair of legs of the male member inserted through the inserting opening;

an engaged portion provided to the top wall and the bottom in the accommodating space of the female member body with which the engaging portion of the male member is engaged; and a guiding receptacle provided to the interior of the accommodating space to guide the engaging portion to the engaged portion, the guiding receptacle being provided to an inner surface of each of the top wall and the bottom wall in a manner that a width of the guiding receptacle gradually narrows from the inserting opening toward the engaged portion; and guides that abut to the engaging portions of the male member to guide the engaging portions to the guiding receptacle when the male member is obliquely inserted into the female member is provided to the inserting opening of the female member, each guide being provided to ends of the top wall and the bottom wall adjacent to the inserting opening on both sides of the inserting opening with the guiding receptacle interposed therebetween, and a distance between the guides provided to the both sides gradually narrows from the ends adjacent to the inserting opening toward the guiding receptacle.

2. The buckle according to claim 1, wherein a relationship of H2 <H3<H1 is satisfied, where HI is a dimension between a face of the guiding receptacle formed on the inner surface of the top wall and a face of the guiding receptacle formed on the inner surface of the bottom wall, H2 is a dimension between the guide formed on the top wall at a side adjacent to the inserting opening and the guide formed on the bottom wall at side adjacent to the inserting opening, and H3 is a dimension between a distal end of a top-side engaging portion projecting from a top side of a distal end of the leg and a distal end of a bottom-side engaging portion projecting from a bottom side of the distal end of the leg.

3. The buckle according to claim 1, wherein:

the male member and the female member are fitted with each other at butting surfaces of the male member and the female member, the butting surface of the female member comprises an expanding portion dented from the inserting opening in an inserting direction of the male member in a U-shape or in a V-shape, the guiding receptacle is provided to a center of the expanding portion and the guides are provided to both sides of the expanding portion, and the butting surface of the male member comprises a projecting portion to be fitted with the expanding portion.

* * * * *

UNITED STATES PATENT AND TRADEMARK OFFICE

CERTIFICATE OF CORRECTION

PATENT NO. : 7,979,966 B2
APPLICATION NO. : 12/174691
DATED : July 19, 2011
INVENTOR(S) : Yoshie It is certified that error appears in the above-identified patent and that said Letters Patent is hereby corrected as shown below:

Column 13

Line 16, "HI" should read --H1--

Signed and Sealed this
Thirty-first Day of January, 2012

David J. Kappos

David J. Kappos
*Director of the United States Patent and Trademark Office*